US009145857B2

(12) United States Patent
Iwaya et al.

(10) Patent No.: US 9,145,857 B2
(45) Date of Patent: Sep. 29, 2015

(54) EVAPORATIVE EMISSION CONTROL DEVICE

(71) Applicant: Mitsubishi Jidosha Kogyo Kabushiki Kaisha, Tokyo (JP)

(72) Inventors: Norifumi Iwaya, Tokyo (JP); Takayuki Sano, Tokyo (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 432 days.

(21) Appl. No.: 13/662,004

(22) Filed: Oct. 26, 2012

(65) Prior Publication Data

US 2013/0104858 A1 May 2, 2013

(30) Foreign Application Priority Data

Oct. 27, 2011 (JP) ..... 2011-236089

(51) Int. Cl.
*F02M 33/04* (2006.01)
*F02M 25/08* (2006.01)
*F02D 41/00* (2006.01)

(52) U.S. Cl.
CPC ..... *F02M 33/04* (2013.01); *F02D 41/003* (2013.01); *F02M 25/089* (2013.01); *F02M 2025/0845* (2013.01)

(58) Field of Classification Search
CPC ..... F02D 41/003–41/0032; F02M 25/08; F02M 25/0836; F02M 25/0845; F02M 25/0872
See application file for complete search history.

(56) References Cited

U.S. PATENT DOCUMENTS

| | | | | |
|---|---|---|---|---|
| 5,317,909 | A * | 6/1994 | Yamada et al. | 73/114.39 |
| 6,371,089 | B1 * | 4/2002 | Matsuoka et al. | 123/519 |
| 2004/0089275 | A1 | 5/2004 | Kidokoro et al. | |
| 2007/0295313 | A1 * | 12/2007 | Amano et al. | 123/520 |
| 2009/0250122 | A1 * | 10/2009 | Menke | 137/511 |
| 2012/0222657 | A1 * | 9/2012 | Sano et al. | 123/520 |
| 2013/0174812 | A1 * | 7/2013 | Miyata et al. | 123/520 |
| 2013/0174813 | A1 * | 7/2013 | Miyata et al. | 123/520 |
| 2014/0123962 | A1 * | 5/2014 | Ide et al. | 123/520 |
| 2014/0144411 | A1 * | 5/2014 | Iwaya et al. | 123/520 |

FOREIGN PATENT DOCUMENTS

| | | | |
|---|---|---|---|
| JP | 11-30156 | A | 2/1999 |
| JP | 11-270794 | A | 10/1999 |
| JP | 2000-110672 | A | 4/2000 |
| JP | 4110932 | B2 | 4/2008 |

* cited by examiner

*Primary Examiner* — Thomas Moulis
*Assistant Examiner* — Elizabeth Hadley
(74) *Attorney, Agent, or Firm* — Birch, Stewart, Kolasch & Birch, LLP

(57) ABSTRACT

A vapor solenoid valve is connected so as to lead to a canister. A vapor line connecting port and a purge line connecting port are connected to a vapor line and a purge line, respectively. When switched on and in an open position, the vapor solenoid valve connects a canister connecting port, the vapor line connecting port and the purge connecting port to each other, and thus allows a fuel evaporative gas to flow out of and into a canister or allows air to flow from an air filter. When switched off and in a CLOSED position, the vapor solenoid valve closes the canister connecting port and connects only the vapor line connecting port and the purge line connecting port to each other, and thus inhibits the fuel evaporative gas from flowing out of and into the canister.

6 Claims, 4 Drawing Sheets

EVAPORATIVE EMISSION CONTROL DEVICE

BACKGROUND OF THE INVENTION

1. Field of the Invention

The present invention relates to an evaporative emission control device, and more specifically, to absorption control of a fuel evaporative gas escaping from a closed fuel tank by using a canister.

2. Description of the Related Art

A conventional technology of preventing a fuel evaporative gas evaporated within a fuel tank from escaping into atmosphere provides a canister connected to a fuel tank, and a fuel tank shutoff valve (sealing valve) that is controlled to close the fuel tank except during fuel supply, which is interposed in a path connecting the fuel tank to the canister, opens the sealing valve during fuel supply to cause the fuel evaporative gas to flow out towards the canister, and thus absorbs the fuel evaporative gas by using the canister.

However, if external temperature rises while the fuel tank is being closed by the sealing valve, fuel in the fuel tank is evaporated, and the pressure in the fuel tank is increased and turned into high pressure.

In the above situation, to prevent the evaporative gas from escaping into atmosphere along with fuel supply, when a fuel supply operation is detected, the sealing valve is opened, and a fuel supply port is inhibited from being opened until the pressure in the fuel tank is sufficiently reduced.

However, the reduction of the pressure in the fuel tank is a long process, which means that it takes a long time before fuel supply starts.

Given this factor, there has been developed a technology in which, if the pressure in the fuel tank is increased during the operation of the engine and the purge process, the sealing valve is opened to release the fuel evaporative gas in the fuel tank into the intake passage of the engine without absorbing the fuel evaporative gas in the canister, thereby reducing the pressure in the fuel tank (Japanese Patent No. 4110932).

The evaporative fuel processor described in the above publication conducts an opening/closing control on a purge vacuum switching valve (purge control valve) for opening/closing a connecting passage that introduces the fuel evaporative gas into the intake passage and the sealing valve at the same time during the operation of the engine in order to reduce the pressure in the fuel tank. In this manner, the purge control valve and the closing valve operate in consort. The fuel evaporative gas that is released into the intake passage of the engine through the connecting passage passes through the canister, so that the fuel evaporative gas is partially absorbed by the canister. This generates the possibility that the amount of the fuel evaporative gas that the canister is capable of absorbing during fuel supply is decreased.

To solve this problem, the canister is disposed in the connecting passage extending between the sealing valve and the purge control valve with a canister shutoff valve (vapor solenoid valve) interposed in the connecting passage. If the pressure in the fuel tank during engine operation is increased and has to be reduced, the vapor solenoid valve is closed, and the sealing valve and the purge control valve are alternately opened. This way, the fuel evaporative gas is prevented from being absorbed by the canister while the fuel evaporative gas in the fuel tank is being released into the intake passage. Some evaporative fuel processors close the purge control valve and open the sealing valve and the purge control valve during fuel supply, to thereby absorb the fuel evaporative gas in the fuel tank by using the canister.

However, if the sealing valve and the purge control valve are alternately opened and closed during engine operation, negative pressure is generated in the connecting passage due to the intake negative pressure of the engine. In addition, the pressure in the fuel tank is positive as the result of fuel evaporation, so that there causes a great pressure difference between in front of and behind the sealing valve. If the sealing valve is opened to release the pressure in the fuel tank under the above situation, there is the possibility that the fuel in the fuel tank is sucked out into the connecting passage due to the great pressure difference or that a valve located in a fuel cutoff valve for preventing a fuel leakage from the fuel tank, which is disposed inside the fuel tank, is attached to the connecting passage. Such fuel suction into the connecting passage incurs a malfunction in engine operation, and may cause a pressure rise in the fuel tank, leading to damage to the fuel tank.

SUMMARY OF THE INVENTION

The present invention has been made to solve the foregoing problems. It is an object of the invention to provide an evaporative emission control device that is capable of reducing differential pressure between a connecting passage and a fuel tank.

In order to achieve the object, the invention provides an evaporative emission control device comprising a connecting passage that connects an intake passage of an internal combustion engine and a fuel tank; a canister that absorbs a fuel evaporative gas existing in the connecting passage; a connecting passage opening/closing unit that opens/closes connection between the connecting passage and the intake passage; a canister opening/closing unit that opens/closes the canister so that the canister is connected to or disconnected from the connecting passage; and a tank opening/closing unit that opens/closes the fuel tank so that the fuel tank is connected to or disconnected from the connecting passage, wherein the evaporative emission control device carried out predetermined purge in which the canister and the fuel tank are closed by switching the canister opening/closing unit and the tank opening/closing unit to a closed position, and the fuel evaporative gas existing in the connecting passage is supplied to the internal combustion engine by switching the connecting passage opening/closing unit to an open position, and then, the evaporative emission control device switch the canister opening/closing unit to an open position so that the canister is opened to the connecting passage.

With the above constitution, after the predetermined purge is completed, the pressure in the connecting passage may become negative due to intake negative pressure of the internal combustion engine. The canister opening/closing unit is therefore switched to the open position, which brings air into the connecting passage through the canister. As a result, the pressure in the connecting passage becomes equal to atmospheric pressure.

Consequently, differential between the pressure in the fuel tank and the pressure in the connecting passage is reduced, so that it is possible to prevent fuel from being sucked from the fuel tank into the connecting passage at the time of switching the tank opening/closing unit to an open position and also prevent a valve located in a fuel cutoff valve disposed in the fuel tank from being attached to the connecting passage.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE PREFERRED EMBODIMENTS

A first embodiment of the invention will be described below with reference to the attached drawings.

First Embodiment

Figure 1:
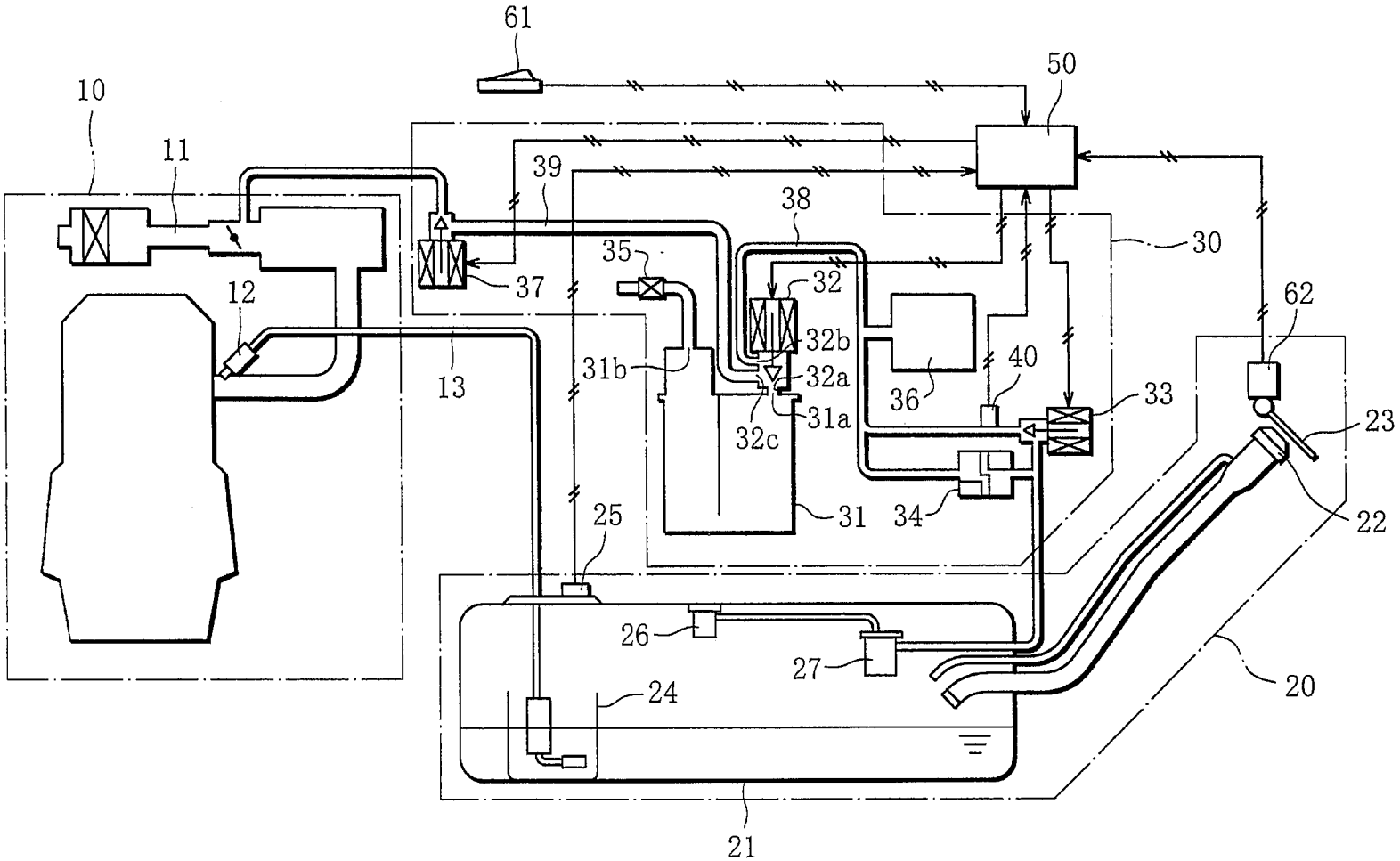
FIG. 1 is a schematic configuration view of an evaporative emission control device according to a first embodiment of the present invention.

FIG. 1 is a schematic configuration view of an evaporative emission control device according to a first embodiment of the present invention. The configuration of the evaporative emission control device according to the first embodiment will be described below.

As shown in FIG. 1, the evaporative emission control device according to the first embodiment is formed mainly of an engine (internal combustion engine) 10 installed in a vehicle; a fuel storage section 20 in which fuel is stored; an evaporative gas processor 30 that processes an evaporative gas of fuel evaporated in the fuel storage section 20; an electrical control unit (hereinafter, referred to as ECU) (operation time detecting unit) 50 that serves as a controller for conducting a comprehensive vehicle control and is formed of an input/output device, a memory unit (ROM, RAM, non-volatile RAM or the like), a central processing unit (CPU), and the like; a fuel supply port lid opening/closing switch 61 for switching between the opening and closing of a fuel supply port lid 23 of the vehicle; and a fuel supply port lid sensor 62 that detects the opening and closing of the fuel supply port lid 23.

The engine 10 is a four-stroke straight-four gasoline engine of an intake-passage-injection (Multi Point Injection (MPI)) type. The engine 10 is provided with an intake passage 11 that takes air into a combustion chamber of the engine 10. In the downstream of the intake passage 11, there is disposed a fuel injection valve 12 that injects fuel into an intake port of the engine 10. The fuel injection valve 12 is connected with a fuel line 13 and is supplied with fuel.

The fuel storage section 20 has a fuel tank 21 in which fuel is stored; a fuel supply port 22 that is a fuel injection port through which fuel is injected into the fuel tank 21; the fuel supply port lid 23 that is a lid of the fuel supply port 22 provided to the vehicle body; a fuel pump 24 for supplying fuel from the fuel tank 21 through the fuel line 13 to the fuel injection valve 12; a pressure sensor (tank pressure detecting unit) 25 that detects pressure in the fuel tank 21; a fuel cutoff valve 26 that includes a float valve, not shown, and prevents fuel from flowing out of the fuel tank 21 into the evaporative gas processor 30 by using the float valve; and a leveling valve 27 that controls liquid level in the fuel tank 21 at the time of fuel supply. The fuel evaporative gas produced in the fuel tank 21 is discharged outside of the fuel tank 21 through the fuel cutoff valve 26 and the leveling valve 27.

The evaporative gas processor 30 has a canister 31, a vapor solenoid valve (canister opening/closing unit) 32, a fuel tank shutoff valve (tank opening/closing unit) 33, a safety valve 34, an air filter 35, a chamber 36, a purge control valve (connecting passage opening/closing unit) 37, a vapor line (connecting passage) 38, a purge line (connecting passage) 39, and a pressure sensor (connecting passage pressure detecting unit) 40.

The canister 31 contains activated carbon. The canister 31 is provided with an evaporative gas passing hole 31*a* through which the fuel evaporative gas produced in the fuel tank 21 or the fuel evaporative gas absorbed by the activated carbon passes. The canister 31 is provided with an air introducing hole 31*b* for introducing outside air into the canister 31 when the fuel evaporative gas absorbed by the activated carbon is discharged. The air introducing hole 31*b* is connected to one side of the air filter 35 for preventing dust from entering the canister 31 from outside, the other side of the air filter 35 being opened into atmosphere.

The vapor solenoid valve 32 is provided with a canister connecting port 32*a* that is so connected as to lead to the evaporative gas passing hole 31*a* of the canister 31. The vapor solenoid valve 32 further has a vapor line connecting port 32*b* that is connected to one end of the vapor line 38, the other end of which is connected to the leveling valve 27 of the fuel tank 21, and a purge line connecting port 32*c* that is connected to one end of the purge line 39, the other end of which is connected to the intake passage 11 of the engine 10. The vapor line connecting port 32*b* and the purge line connecting port 32*c* of the vapor solenoid valve 32 are connected to the vapor line 38 and the purge line 39, respectively. The vapor solenoid valve 32 is an electromagnetic valve of a normally-closed type, which is closed when switched off and is opened when switched on by being supplied with an activation signal from outside. The vapor solenoid valve 32 connects the canister connecting port 32*a*, the vapor line connecting port 32*b* and the purge line connecting port 32*c* when switched on and in an open position by being supplied with the activation signal from outside. This enables the fuel evaporative gas to flow into and out of the canister 31 and also allows the air introduced from the air filter 35 to flow into the vapor line 38 and the purge line 39. When switched off and in a closed position, the vapor solenoid valve 32 closes the canister connecting port 32*a* and connects only the vapor line connecting port 32*b* and the purge line connecting port 32*c* to each other, thereby inhibiting the fuel evaporative gas from flowing into and out of the canister 31 and also inhibiting air from being introduced from the air filter 35 to the vapor line 38 and the purge line 39. In short, the vapor solenoid valve 32 closes the canister 31 when in the closed position, and opens the canister 31 when in the open position.

A fuel tank shutoff valve 33 is interposed in the vapor line 38. The fuel tank shutoff valve 33 is an electromagnetic valve of a normally-closed type, which is closed when switched off and is opened when switched on by being supplied with an activation signal from outside. The fuel tank shutoff valve 33 blocks the vapor line 38 when switched off and in the closed position, and opens the vapor line 38 when switched on and in the open position by being supplied with the activation signal from outside. That is to say, the fuel tank shutoff valve 33 tightly closes the fuel tank 21 when in the closed position, to thereby inhibit the fuel evaporative gas produced in the fuel tank 21 from flowing out of the fuel tank 21, and allows the fuel evaporative gas to flow into the canister 31 when in the open position.

The safety valve 34 is interposed in the vapor line 38 in parallel with the fuel tank shutoff valve 33. The safety valve 34 is opened when the pressure in the fuel tank 21 is increased. By so doing, the safety valve 34 releases the pressure to the canister 32 and thus prevents a burst of the fuel tank 21.

The chamber 36 is connected to the vapor line 38 extending between the vapor solenoid valve 32 and the fuel tank shutoff valve 33. The chamber 36 is for temporarily storing the fuel evaporative gas that flows out of the fuel tank 21.

The purge control valve 37 is interposed in the purge line 39 extending between the intake passage 11 of the engine 10 and the vapor solenoid valve 32. The purge control valve 37 is an electromagnetic valve of a normally-closed type, which is closed when switched off and is opened when switched on by being supplied with an activation signal from outside. The purge control valve 37 blocks the purge line 39 when switched off and in a closed position, and opens the purge line 39 when switched on and in an open position by being supplied with an activation signal from outside. In short, the purge control valve 37 inhibits the fuel evaporative gas from flowing from the evaporative gas processor 30 to the engine 10 when in the closed position, and allows the fuel evaporative gas to flow to the engine 10 when in the open position.

The pressure sensor 40 is interposed in the vapor line 38 extending between the vapor solenoid valve 32 and the fuel tank shutoff valve 33, and detects pressure in the vapor line 38. The pressure sensor 40 is not limited to detect the pressure in the vapor line 38 extending between the fuel tank shutoff valve 33 and the purge control valve 37 as described above. On the contrary, the pressure sensor 40 may be provided to detect the pressure in the purge line 39 or the chamber 36 located between the fuel tank shutoff valve 33 and the purge control valve 37.

The ECU 50 is a controller for conducting the comprehensive vehicle control and includes the input/output device, the memory unit (ROM, RAM, non-volatile RAM or the like), the central processing unit (CPU), a timer, etc.

Connected to an input side of the ECU 50 are the pressure sensors 25 and 40, the fuel supply port opening/closing switch 61 that switches between the opening and closing of the fuel supply port lid 23 of the vehicle, and the fuel supply port lid sensor 62 that detects the opening and closing of the fuel supply port lid 23. Detected information from these sensors is entered into the ECU 50.

Connected to an output side of the ECU 50 are the fuel injection valve 12, the fuel pump 24, the vapor solenoid valve 32, the fuel tank shutoff valve 33 and the purge control valve 37.

On the basis of the detected information from the various sensors, the ECU 50 controls the opening/closing the vapor solenoid valve 32, the fuel tank shutoff valve 33 and the purge control valve 37, and also controls the pressure in the fuel tank 21, the pressure in the vapor line 38, the purge line 39 and the chamber 36 located between the fuel tank shutoff valve 33 and the purge control valve 37.

The following description explains the control on the pressure in the fuel tank 21 by using the ECU 50 according to a first embodiment of the invention configured in the above-described manner.

Figure 2:
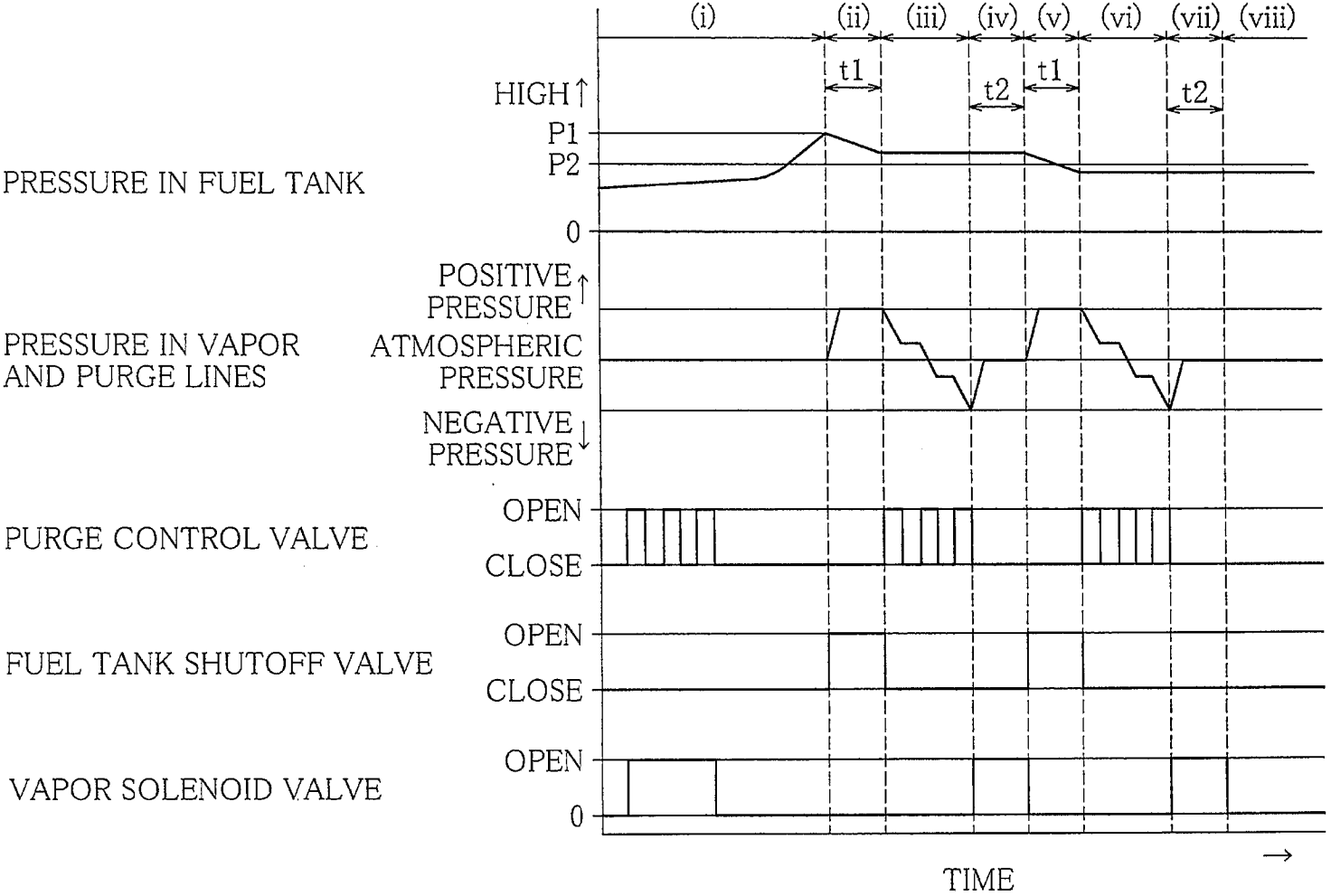
FIG. 2 shows, in chronological order, operations of a purge control valve, a fuel tank shutoff valve and a vapor solenoid valve, and transition of pressure in a fuel tank and that in vapor and purge lines according to the first embodiment of the invention.

FIG. 2 shows, in chronological order, operations of the purge control valve 37, the fuel tank shutoff valve 33 and the vapor solenoid valve 32, and transition of pressure in the fuel tank and that in the vapor and purge lines. In FIG. 2, P1, P2, t1, and t2 represent a first predetermined value, a second predetermined value, a first predetermined period, and a second predetermined period, respectively.

As shown in FIG. 2, during the operation of the engine 10, a canister purge control is conducted, in which the fuel evaporative gas absorbed by the activated carbon of the canister 31 during fuel supply is supplied to the engine 10 by controlling the opening/closing of the vapor solenoid valve 32, the fuel tank shutoff valve 33 and the purge control valve 37, and the fuel evaporative gas is then combusted in the engine 10 (FIG. 2(*i*)).

If a detected value of the pressure in the fuel tank 21, which is detected by the pressure sensor 25, becomes equal to or higher than the first predetermined value (set value) P1, the fuel tank shutoff valve 33 is supplied with the activation signal to be switched on while the vapor solenoid valve 32 is being in the closed position, whereby the fuel tank shutoff valve 33 is opened for the first predetermined period t1. This way, the fuel evaporative gas is allowed to flow out of the fuel tank 21. In other words, the fuel tank shutoff valve 33 is opened while the vapor solenoid valve 32 is being in the closed position, and thus, the fuel evaporative gas is introduced into the purge line 39 up to the purge control valve 37 and into the chamber 36 without contacting the activated carbon located in the canister 31 (FIG. 2(*ii*)).

After a lapse of the first predetermined period t1, the supply of the activation signal to the fuel tank shutoff valve 33 is stopped, to thereby switch off and close the fuel tank shutoff valve 33. This way, the fuel evaporative gas is inhibited from flowing out of the fuel tank 21. Thereafter, the activation signal is supplied to the purge control valve 37 predetermined times (three times in the present embodiment) at intervals. The purge control valve 37 is therefore intermittently switched on, thereby being opened the predetermined times at intervals. The purge control valve 37 is opened the predetermined times at intervals, so that the fuel evaporative gas introduced into the purge line 39 up to the purge control valve 37 and into the chamber 36 is supplied to and combusted in the engine 10. In the present embodiment, predetermined purge closes the fuel tank shutoff valve 33 and supplies the fuel evaporative gas to the internal combustion engine with the vapor solenoid valve 32 in the closed position (FIG. 2(*iii*)).

Next the supply of the activation signal to the purge control valve 37 is stopped, so that the purge control valve 37 is switched off and closed. If the pressure in the vapor line 38, the purge line 39 and the chamber 36 located between the fuel tank shutoff valve 33 and the purge control valve 37, which is detected by the pressure sensor 40, is lower than atmospheric pressure, the vapor solenoid valve 32 is switched on and opened by being supplied with the activation signal. The canister 31, the vapor line 38 and the purge line 39 are then connected to each other. The air introduced from the air filter 35 is accordingly allowed to flow into the vapor line 38 and the purge line 39. The air is introduced into the vapor line 38, the purge line 39 and the chamber 36 located between the fuel tank shutoff valve 33 and the purge control valve 37 until the second predetermined period t2 that is previously determined by experiment or the like, in which negative pressure generated during the opening period of the purge control valve 37 can be turned into atmospheric pressure (FIG. 2(*iv*)). The opening period of the purge control valve 37 is determined as the second predetermined period t2 here, but may be determined as a time period before the detected value that is detected by the pressure sensor 40 becomes equal to or higher than the atmospheric pressure.

If the detected value of the pressure in the fuel tank 21, which is detected by the pressure sensor 25, is not lower than the second predetermined value P2, the supply of activation signals to the vapor solenoid valve 32 and the purge control valve 37 is stopped, to thereby switch off and close the purge control valve 37 as in FIG. 2(*ii*). The fuel tank shutoff valve 33 is switched on by being supplied with the activation signal. The fuel tank shutoff valve 33 is opened for the first predetermined period t1 so that the fuel evaporative gas is allowed to flow out of the fuel tank 21. This way, the fuel evaporative gas is again introduced into the purge line 39 up to the purge control valve 37 and into the chamber 36 (FIG. 2(*v*)).

As in FIG. 2(*iii*), after a lapse of the first predetermined period t1, the supply of the activation signal to the fuel tank shutoff valve 33 is stopped, to thereby switch off and close the fuel tank shutoff valve 33. This way, the fuel evaporative gas is inhibited from flowing out of the fuel tank 21. The predetermined purge is turned on again, in which the purge control valve 37 is intermittently switched on by being supplied with the activation signal predetermined times at intervals so as to be opened the predetermined times at intervals, and the fuel evaporative gas introduced into the purge line 39 up to the purge control valve 37 and into the chamber 36 is supplied to and combusted in the engine 10 (FIG. 2(*vi*)).

As in FIG. 2(*iv*), the supply of the activation signal to the purge control valve 37 is stopped to switch off and close the purge control valve 37. If the pressure in the vapor line 38, the purge line 39 and the chamber 36 located between the fuel tank shutoff valve 33 and the purge control valve 37, which is detected by the pressure sensor 40, is lower than atmospheric pressure, the vapor solenoid valve 32 is switched on and opened by being supplied with the activation signal. The canister 31, the vapor line 38 and the purge line 39 are then connected to each other. The air introduced from the air filter 35 is accordingly allowed to flow into the vapor line 38 and the purge line 39. The air is introduced into the vapor line 38, the purge line 39 and the chamber 36 located between the fuel tank shutoff valve 33 and the purge control valve 37 until the second predetermined period t2 that is previously determined by experiment or the like, in which negative pressure generated during the opening period of the purge control valve 37 can be turned into atmospheric pressure (FIG. 2(*vii*)).

If the detected value of the pressure in the fuel tank 21, which is detected by the pressure sensor 25, becomes lower than the second predetermined value P2, the supply of the activation signal to the vapor solenoid valve 33 is stopped, to thereby switch off and close the vapor solenoid valve 33 (FIG. 2(*viii*)).

As described above, in the evaporative emission control device according to the first embodiment of the present invention, when the pressure in the fuel tank 21 becomes equal to or higher than the first predetermined value P1, the fuel tank shutoff valve 33 is opened after the vapor solenoid valve 32 is closed. The fuel evaporative gas is thus introduced into vapor line 38 and the purge line 39 up to the purge control valve 37 and into the chamber 36. The predetermined purge is turned on, in which after the fuel tank shutoff valve 33 is closed, the purge control valve 37 is opened predetermined times at intervals; the fuel evaporative gas introduced into the vapor line 38 and the purge line 39 up to the purge control valve 37 and into the chamber 36 is sucked into the intake passage 11 of the engine 10 due to an intake negative pressure of the engine 10, whereby the fuel evaporative gas is supplied to and combusted in the engine 10. After the purge control valve 37 is closed, if the pressure in the vapor line 38, the purge line 39 and the chamber 36 located between the fuel tank shutoff valve 33 and the purge control valve 37 is negative, the vapor solenoid valve 32 is opened.

If the vapor solenoid valve 32 is opened when the pressure in the vapor line 38, the purge line 39 and the chamber 36 located between the fuel tank shutoff valve 33 and the purge control valve 37 is negative due to the intake negative pressure of the engine 10, air is introduced into the vapor line 38, the purge line 39 and the chamber 36 located between the fuel tank shutoff valve 33 and the purge control valve 37, passing through the air filter 35 and the canister 31. This makes the pressure in the vapor line 38, the purge line 39 and the chamber 36 located between the fuel tank shutoff valve 33 and the purge control valve 37 turn into atmospheric pressure.

As a result, differential between the pressure in the fuel tank 21 and the pressure in the vapor line 38, the purge line 39 and the chamber 36 located between the fuel tank shutoff valve 33 and the purge control valve 37 is reduced. This makes it possible to prevent fuel from being sucked from the fuel tank 21 into the vapor line 38 and also prevent the float valve located in the fuel cutoff valve 26 from being attached to the vapor line 38 when the fuel tank shutoff valve 33 is opened.

Furthermore, since the pressure in the vapor line 38, the purge line 39 and the chamber 36 located between the fuel tank shutoff valve 33 and the purge control valve 37 is detected by the pressure sensor 40, when the pressure in the vapor line 38, the purge line 39 and the chamber 36 located between the fuel tank shutoff valve 33 and the purge control valve 37 becomes negative, the canister 31 is opened without fail. This enables the pressure in the vapor line 38, the purge line 39 and the chamber 36 located between the fuel tank shutoff valve 33 and the purge control valve 37 to be turned into atmospheric pressure.

Moreover, since the pressure in the vapor line 38, the purge line 39 and the chamber 36 located between the fuel tank shutoff valve 33 and the purge control valve 37 is detected by the pressure sensor 40, and the negative pressure in the vapor line 38, the purge line 39 and the chamber 36 located between the fuel tank shutoff valve 33 and the purge control valve 37 can be accurately detected, when the pressure in the vapor line 38, the purge line 39 and the chamber 36 located between the fuel tank shutoff valve 33 and the purge control valve 37 is negative, the pressure can be approximated to atmospheric pressure by opening the vapor solenoid valve 32 without fail.

In addition, the pressure sensor 25 for detecting the inner pressure of the fuel tank 21 is provided and monitors the inner pressure of the fuel tank 21. It is therefore possible to turn on the predetermined purge, as needed, in which the fuel tank 21 is opened by opening the fuel tank shutoff valve 33 when the inner pressure of the fuel tank 21 becomes equal to or higher than the first predetermined value P1.

Second Embodiment

The evaporative emission control device according to the second embodiment of the invention will be described below.

Figure 3:
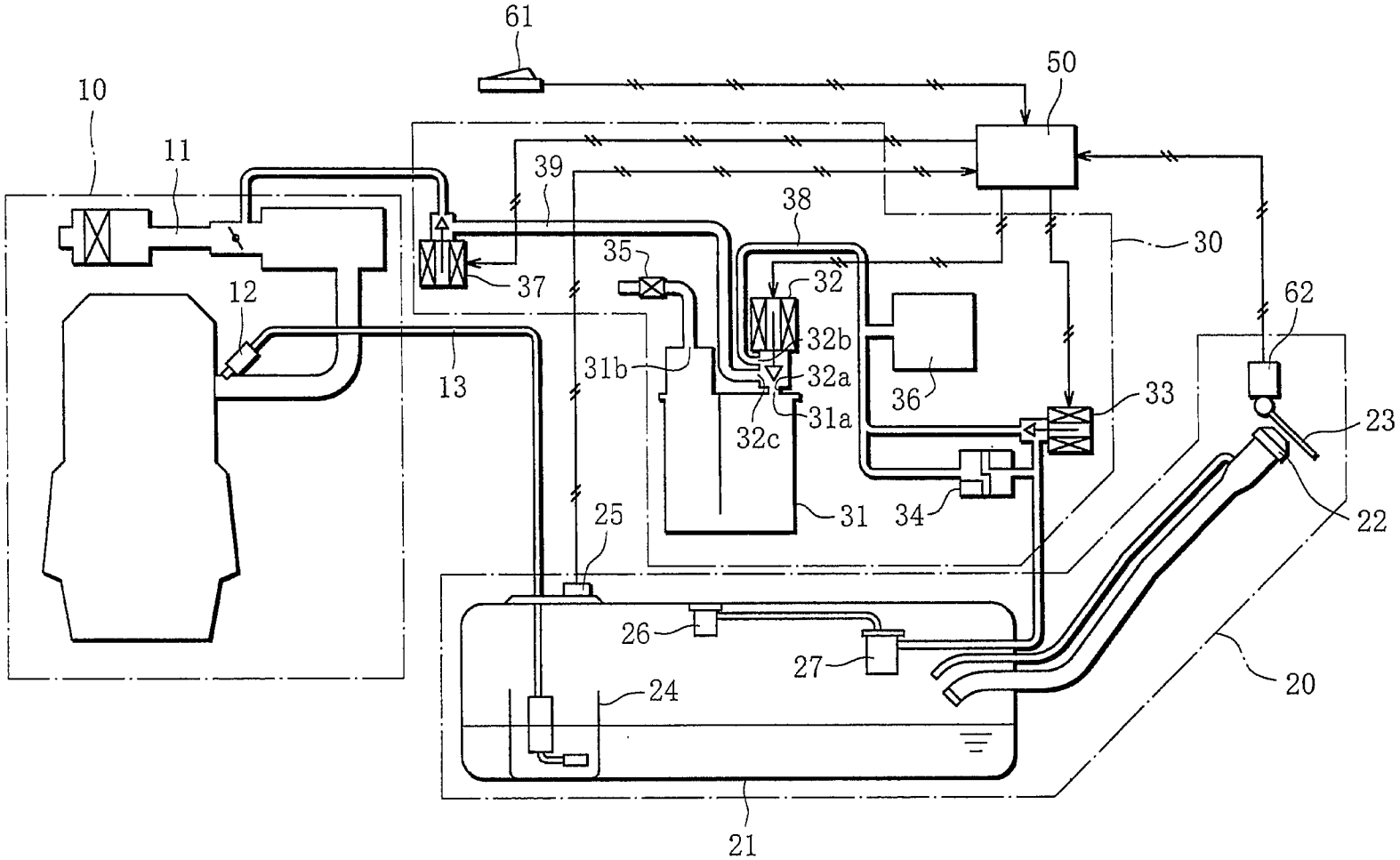
FIG. 3 is a schematic configuration view of an evaporative emission control device according to a second embodiment of the present invention.
Figure 4:
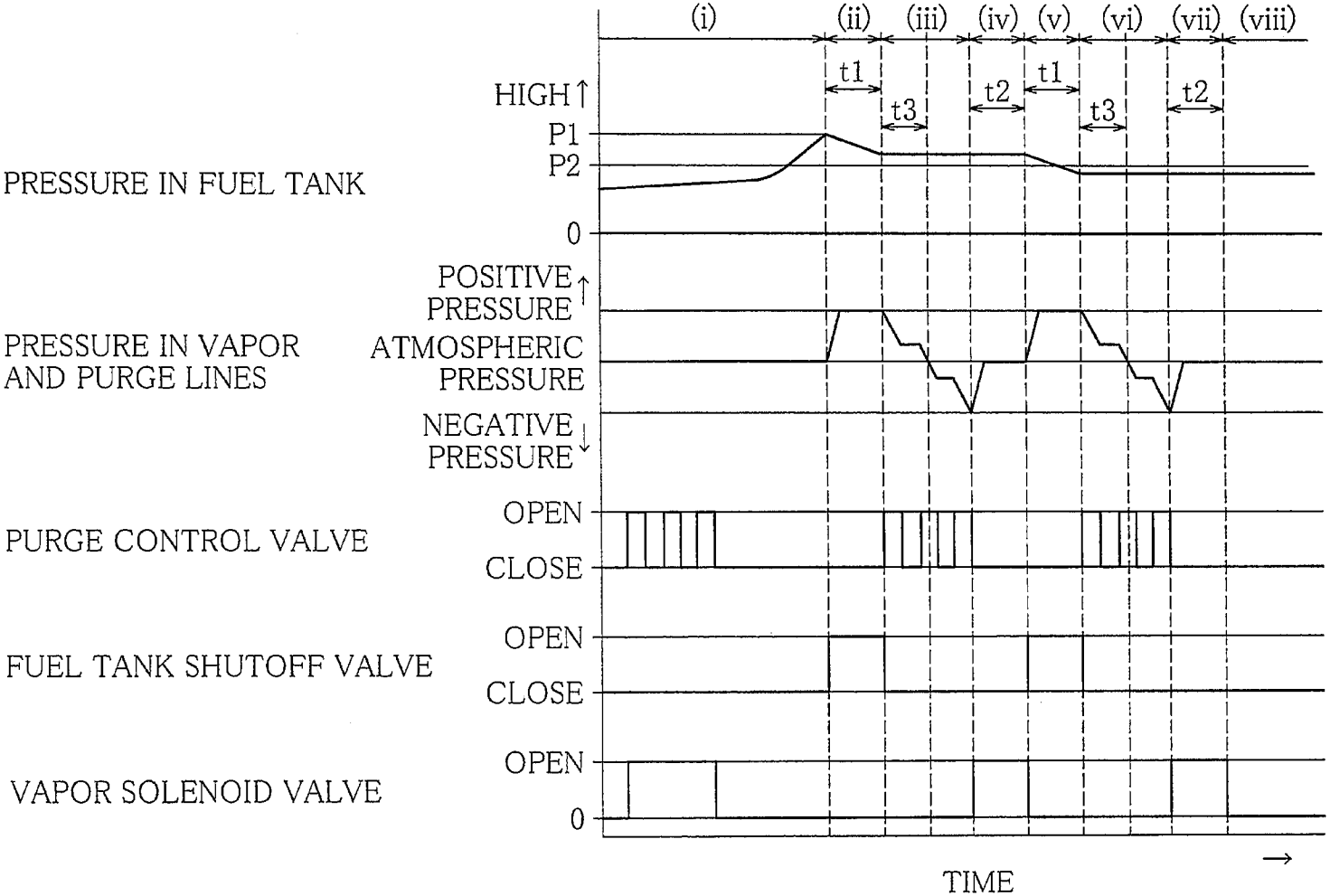
FIG. 4 shows, in chronological order, operations of the purge control valve, the fuel tank shutoff valve and the vapor solenoid valve, and transition of pressure in the fuel tank and that in the vapor and purge lines according to the second embodiment of the invention.

FIG. 3 is a schematic configuration view of the evaporative emission control device according to the second embodiment of the invention. In FIG. 4, P1, P2, t1, t2 and t3 represent a first predetermined value, a second predetermined value, a first predetermined period, a second predetermined period, and a third predetermined period, respectively. As shown in FIG. 3, the pressure sensor 40 is not provided in the second embodiment. Although the first embodiment uses the pressure sensor 40 to detect the negative pressure in the vapor line 38, the purge line 39 and the chamber 36 located between the fuel tank shutoff valve 33 and the purge control valve 37, the second embodiment previously determines, by experiment or the like, the third predetermined period t3 that starts from the opening of the purge control valve 37 and lasts until the pressure in the vapor line 38, the purge line 39 and the chamber 36 located between the fuel tank shutoff valve 33 and the purge control valve 37 becomes negative, stores the third period t3 on the ECU 50, and controls the opening/closing of the vapor solenoid valve 32 according to the third predetermined period t3. The second embodiment differs from the first in this respect. Accordingly, the method of controlling the pressure in the fuel tank 21 by using the ECU 50 is also different between the first and second embodiments. The explanation below is about how to control the pressure in the fuel tank 21 by using the ECU 50.

FIG. 4 shows, in chronological order, operations of the purge control valve 37, the fuel tank shutoff valve 33 and the vapor solenoid valve 32, and transition of inner pressure in the fuel tank and of inner pressure in the vapor and purge lines in the evaporative emission control device according to the second embodiment of the invention.

As shown in FIG. 4, like the first embodiment, during the operation of the engine 10, the second embodiment conducts the canister purge control that controls the opening/closing of the vapor solenoid valve 32, the fuel tank shutoff valve 33 and the purge control valve 37, supplies the fuel evaporative gas absorbed by the activated carbon of the canister 31 during fuel supply, and combusts the fuel evaporative gas in the engine 10 (FIG. 4(*i*)).

If a detected value of the pressure in the fuel tank 21, which is detected by the pressure sensor 25, becomes equal to or higher than the first predetermined value (set value) P1, the fuel tank shutoff valve 33 is supplied with the activation signal to be switched on while the vapor solenoid valve 32 is being in the closed position, whereby the fuel tank shutoff valve 33 is opened for the first predetermined period t1. The fuel evaporative gas is therefore allowed to flow out of the fuel tank 21. In other words, the fuel tank shutoff valve 33 is opened while the vapor solenoid valve 32 is being in the closed position, and thus, the fuel evaporative gas is introduced into the purge line 39 up to the purge control valve 37 and into the chamber 36 without contacting the activated carbon located in the canister 31 (FIG. 4(*ii*)).

After a lapse of the first predetermined period t 1, the supply of the activation signal to the fuel tank shutoff valve 33 is stopped, to thereby switch off and close the fuel tank shutoff valve 33. This way, the fuel evaporative gas is inhibited from flowing out of the fuel tank 21. The activation signal is then supplied to the purge control valve 37 predetermined times (three times in the present embodiment) at intervals. The purge control valve 37 is therefore intermittently switched on, thereby being opened the predetermined times at intervals. The purge control valve 37 is opened the predetermined times at intervals, so that the fuel evaporative gas introduced into the purge line 39 up to the purge control valve 37 and into the chamber 36 is supplied to and combusted in the engine 10. In addition, the opening period of the purge control valve 37 is detected (FIG. 4(*iii*)).

Next the supply of the activation signal to the purge control valve 37 is stopped to switch off the purge control valve 37. This way, the purge control valve 37 is closed. Thereafter, if the opening period of the purge control valve 37, which is detected in FIG. 4(*iii*), is equal to or longer than the third predetermined period t3 that is previously determined by experiment, which starts from the opening of the purge control valve 37 and lasts until the pressure in the vapor line 38, the purge line 39 and the chamber 36 located between the fuel tank shutoff valve 33 and the purge control valve 37 becomes negative, it is determined that the pressure in the vapor line 38, the purge line 39 and the chamber 36 located between the fuel tank shutoff valve 33 and the purge control valve 37 is lower than atmospheric pressure. The vapor solenoid valve 32 is then supplied with the activation signal to be switched on and opened. The canister 31, the vapor line 38 and the purge line 39 are then connected to each other. The air introduced from the air filter 35 is accordingly allowed to flow into the vapor line 38 and the purge line 39. The air is introduced into the vapor line 38 and the purge line 39 and the chamber 36 located between the fuel tank shutoff valve 33 and the purge control valve 37 until the second predetermined period t2 that is previously determined by experiment or the like, in which negative pressure generated during the opening period of the purge control valve 37 can be turned into atmospheric pressure (FIG. 4(*iv*)).

If the detected value of the pressure in the fuel tank 21, which is detected by the pressure sensor 25, is not lower than the second predetermined value P2, the supply of activation signals to the vapor solenoid valve 32 and the purge control valve 37 is stopped, to thereby switch off and close the vapor solenoid valve 32 and the purge control valve 37 as in FIG. 4(*ii*). The fuel tank shutoff valve 33 is then switched on by being supplied with the activation signal. The fuel tank shutoff valve 33 is opened for the first predetermined period t1, so that the fuel evaporative gas is allowed to flow out of the fuel tank 21. This way, the fuel evaporative gas is again introduced into the purge line 39 up to the purge control valve 37 and into the chamber 36 (FIG. 4(*v*)).

As in FIG. 4(*iii*), after a lapse of the first predetermined period t1, the supply of the activation signal to the fuel tank shutoff valve 33 is stopped, to thereby switch off and close the fuel tank shutoff valve 33. This way, the fuel evaporative gas is inhibited from flowing out of the fuel tank 21. The purge control valve 37 is then intermittently switched on by being supplied with the activation signal predetermined times at intervals so that the purge control valve 37 is opened the predetermined times at intervals, and the fuel evaporative gas introduced into the purge line 39 up to the purge control valve 37 and into the chamber 36 is supplied to and combusted in the engine 10. In addition, the opening period of the purge control valve 37 is detected (FIG. 4(*vi*)).

As in FIG. 4(*iv*), the supply of the activation signal to the purge control valve 37 is stopped to switch off the purge control valve 37. This way, the purge control valve 37 is closed. Thereafter, if the opening period of the purge control valve 37, which is detected in FIG. 4(*iii*), is equal to or longer than the third predetermined period t3 that is previously determined by experiment or the like, which starts from the opening of the purge control valve 37 and lasts until the pressure in the vapor line 38, the purge line 39 and the chamber 36 located between the fuel tank shutoff valve 33 and the purge control valve 37 becomes negative, it is determined that the pressure in the vapor line 38, the purge line 39 and the chamber 36 located between the fuel tank shutoff valve 33 and the purge control valve 37 is lower than atmospheric pressure. The vapor solenoid valve 32 is then supplied with the activation signal to be switched on and opened. The canister 31, the vapor line 38 and the purge line 39 are then connected to each other. The air introduced from the air filter 35 is accordingly allowed to flow into the vapor line 38 and the purge line 39. The air is introduced into the vapor line 38 and the purge line 39 and the chamber 36 located between the fuel tank shutoff valve 33 and the purge control valve 37 until the second predetermined period t2 that is previously determined by experiment or the like, in which negative pressure generated during the opening period of the purge control valve 37 can be turned into atmospheric pressure (FIG. 4(*vii*)).

If the detected value of the pressure in the fuel tank 21, which is detected by the pressure sensor 25, becomes lower than the second predetermined value P2, the supply of the activation signal to the vapor solenoid valve 33 is stopped, to thereby switch off and close the vapor solenoid valve 33 (FIG. 4(*viii*)).

As described above, in the evaporative emission control device according to the second embodiment of the invention, the negative pressure in the vapor line 38, the purge line 39 and the chamber 36 located between the fuel tank shutoff valve 33 and the purge control valve 37 is detected by monitoring whether or not the opening period of the purge control valve 37 is equal to or longer than the third predetermined period t3 that starts from the opening of the purge control valve 37 and lasts until the pressure in the vapor line 38, the purge line 39 and the chamber 36 located between the fuel tank shutoff valve 33 and the purge control valve 37 becomes negative. The evaporative emission control device according to the second embodiment is capable of determining the negative pressure in the vapor line 38, the purge line 39 and the chamber 36 located between the fuel tank shutoff valve 33 and the purge control valve 37 without a pressure sensor. The evaporative emission control device is therefore also capable of preventing the fuel from being sucked from the fuel tank to the connecting passage and preventing the valve located in the fuel cutoff valve from being attached to the connecting passage while avoiding cost increase.

What is claimed is:

1. An evaporative emission control device comprising:

a control unit; a connecting passage that connects an intake passage of an internal combustion engine and a fuel tank; a canister that absorbs a fuel evaporative gas existing in the connecting passage; a connecting passage opening/closing unit, controlled by the control unit, that opens/closes connection between the connecting passage and the intake passage; a canister opening/closing unit, controlled by the control unit, that opens/closes the canister so that the canister is connected to or disconnected from the connecting passage; and a tank opening/closing unit, controlled by the control unit, that opens/closes the fuel tank so that the fuel tank is connected to or disconnected from the connecting passage, wherein the control unit carries out (a) a predetermined purge in which the canister and the fuel tank are closed by switching the canister opening/closing unit and the tank opening/closing unit to a closed position, and the fuel evaporative gas existing in the connecting passage is supplied to the internal combustion engine by switching the connecting passage opening/closing unit to an open position, and then, (b) the control unit switches the connecting passage opening/closing unit to a closed position and the canister opening/closing unit to an open position so that the canister is opened to the connecting passage.

2. The evaporative emission control device according to claim 1, wherein there is provided a connecting passage pressure detecting unit that detects pressure in the connecting passage, and the evaporative emission control device opens the canister opening/closing unit when the pressure in the connecting passage, which is detected by the connecting passage pressure detecting unit, is negative, and thus opens the canister to the connecting passage.

3. The evaporative emission control device according to claim 1, wherein there is provided a tank pressure detecting unit that detects pressure in the fuel tank, and when the pressure in the fuel tank, which is detected by the tank pressure detecting unit, becomes equal to or higher than a set value, the evaporative emission control device opens the fuel tank by switching the tank opening/closing unit to an open position and carries out the predetermined purge.

4. The evaporative emission control device according to claim 2, wherein there is provided a tank pressure detecting unit that detects pressure in the fuel tank, and when the pressure in the fuel tank, which is detected by the tank pressure detecting unit, becomes equal to or higher than a set value, the evaporative emission control device opens the fuel tank by switching the tank opening/closing unit to an open position and carries out the predetermined purge.

5. The evaporative emission control device according to claim 1, wherein there is provided an operation time detecting unit that measures the operation time of the connecting passage opening/closing unit, and after a lapse of a predetermined period that starts from the opening of the connecting passage opening/closing unit and lasts until the pressure in the connecting passage extending between the connecting passage opening/closing unit and the tank opening/closing unit becomes negative, the evaporative emission control device opens the canister to the connecting passage.

6. The evaporative emission control device according to claim 1, further comprising:

a tank pressure detecting unit that detects pressure in the fuel tank, wherein the control unit repeats (a) and (b) until the detected pressure in the fuel tank becomes lower than a predetermined value.

* * * * *